United States Patent [19]

Nishikawa et al.

[11] 4,218,190

[45] Aug. 19, 1980

[54] FLAT-BLADED FAN WHEEL OF DIAGONAL-FLOW FAN

[75] Inventors: Yoshiyasu Nishikawa, Ono; Masao Nakano, Kobe, both of Japan

[73] Assignee: Kawasaki Jukogyo Kabushiki Kaisha, Kobe, Japan

[21] Appl. No.: 900,646

[22] Filed: Apr. 26, 1978

[30] Foreign Application Priority Data

Jun. 29, 1977 [JP] Japan ..... 52/78167

[51] Int. Cl.[3] ..... F01D 5/22

[52] U.S. Cl. ..... 416/186 R; 416/188; 416/DIG. 2; 416/DIG. 3

[58] Field of Search ..... 416/186, 185, 188, DIG. 2, 416/DIG. 3

[56] References Cited

U.S. PATENT DOCUMENTS

| | | | |
|---|---|---|---|
| 416,070 | 11/1889 | Pelzer | 416/186 |
| 2,054,144 | 7/1934 | Swigert | 416/186 |
| 3,224,079 | 12/1965 | Dybvig | 416/186 |
| 3,440,969 | 4/1969 | Kondo | 416/185 |
| 3,584,968 | 6/1971 | Keith | 416/186 |
| 3,668,887 | 6/1972 | Riello | 416/186 |
| 4,120,609 | 10/1978 | Chou et al. | 416/DIG. 3 |

FOREIGN PATENT DOCUMENTS

| | | | |
|---|---|---|---|
| 1077981 | 3/1960 | Fed. Rep. of Germany | 415/210 |
| 1401429 | 11/1968 | Fed. Rep. of Germany | 416/185 |
| 1126364 | 11/1956 | France | 416/188 |
| 2356025 | 1/1978 | France | 416/186 |
| 62691 | 7/1940 | Norway | 416/188 |

*Primary Examiner*—Everette A. Powell, Jr.
*Assistant Examiner*—A. N. Trausch, III
*Attorney, Agent, or Firm*—Haseltine, Lake & Waters

[57] ABSTRACT

A blade in the fan wheel of a diagonal-flow fan, which blade should ideally have the contoured shape of a twisted double-curvature or undevelopable surface, is formed from a portion of a plate which has a flat planar surface. To develope the flat blade shape from a planar surface, lines of intersection between a plate and the streamsurfaces in the ideal fan wheel, which are represented by a number of coaxial imaginary conical surfaces, are used as a basis for design. The realized flat blade can then be orientated between the frustoconical main and side plates to form a diagonal-flow path similar in performance to the ideal blade of a twisted double-curvature surface.

2 Claims, 16 Drawing Figures

FLAT-BLADED FAN WHEEL OF DIAGONAL-FLOW FAN

BACKGROUND OF THE INVENTION

This invention relates generally to fans and blowers for delivering gases at specific flow rates and pressures and more particularly to an impeller or fan wheel of a diagonal-flow fan, the fan wheel being provided with blades each of the shape of a planar surface which affords high performance of the fan substantially equivalent to that of the fan provided with blades each of an ideal shape of a twisted double-curvature surface.

In the fan wheel of an ordinary centrifugal fan of the straight-line, rearwardly inclined (so-called plate-turbo) type, the entrance edges and exit edges of the blades are respectively parallel to the rotational shaft axis. At the same time, when the fan wheel is viewed in its axial direction, each of its blades is linearly formed as it extends toward the periphery of the fan wheel, and each blade has no twist with respect to the axial direction, and cross sections of the blades taken in parallel planes perpendicular to the axis appear to be superposed on each other. Thus, each blade has a planar surface.

Accordingly, the fabrication of these blades is relatively simple. However, the planar shape of the blade of this kind is disadvantageous from the viewpoint of fluid dynamics, and therefore, a fan provided with blades of this type has a low efficiency.

In contrast to the centrifugal fan as described above, a diagonal-flow fan has blades whose entrance edges and exit edges are not parallel to the rotational shaft axis, the radial distance from the shaft axis to each entrance edge varying progressively from one end of the entrance edge to the other, and furthermore, the radial distance from the shaft axis to each exit edge also varying progressively from one end of the exit edge to the other. In addition, each blade must be provided with a complicated double curvature which causes it to have a twist as viewed in the shaft axial direction. These and other features of diagonal-flow fans will be described in detail hereinafter, particularly in comparison with a centrifugal fan.

Theoretically, a diagonal-flow fan should have excellent performance but has not be reduced to practical use because of certain difficulties as will be described hereinafter.

SUMMARY OF THE INVENTION

It is an ojbect of this invention to provide a fan wheel of a diagonal-flow fan of straight-line, rearwardly inclined type in which, by utilizing a part of a plane for each blade of the fan wheel, an effect equivalent to that of rearwardly-curved blades of double-curvature surfaces which are close to the ideal from the viewpoint of fluid dynamics is attained to produce excellent fan performance, and, moreover, the difficulties accompanying the fabrication of diagonal-flow fan blades are overcome thereby to facilitate the production of the fan wheel.

Other objects and further features of this invention will be apparent from the following detailed description when read in conjunction with the accompanying drawings in which, like parts are designated by like reference numerals and characters.

DETAILED DESCRIPTION OF THE INVENTION

As conducive to a full understanding of this invention, the differences between a centrifugal fan and a diagonal-flow fan and certain problems accompanying diagonal-flow fans, which were briefly mentioned hereinbelow, will first be described more fully.

Figure 1:
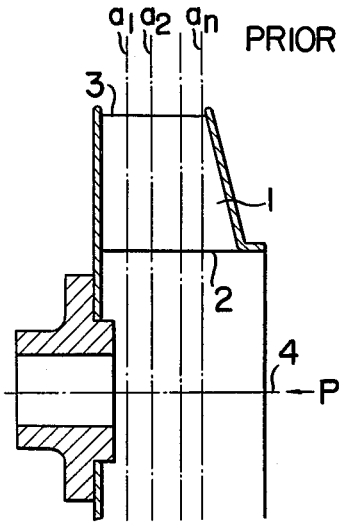
FIG. 1 PRIOR ART
FIG. 1 is a partial side view, in section taken along a plane passing through the axis of rotation, of a fanwheel of an ordinary centrifugal fan of the straight-line rearwardly inclined type.

Referring first to FIG. 1, the fan wheel shown therein of an ordinary centrifugal fan of the straight-line, rearwardly inclined (so-called plate-turbo) type has a number of blades 1, each having an entrance edge 2 and an exit edge 3 both of which are parallel to the rotational shaft axis 4. As viewed in the axial direction (arrow direction P), each blade 1 is inclined rearwardly (rearward facing) in the direction opposite to the direction of rotation S. Each blade, however, has no inclination in the direction of the shaft axis, and the sections of the blades respectively in spaced apart and parallel planes $a_1, a_2, \ldots a_n$ intersecting the shaft axis 4 at right angles appear to be superposed on each other. Thus, each blade 1 has a planar shape.

Therefore, each blade 1 of a fan wheel of this type can be fabricated in a simple manner by cutting it from a flat plate stock.

Figure 3A:
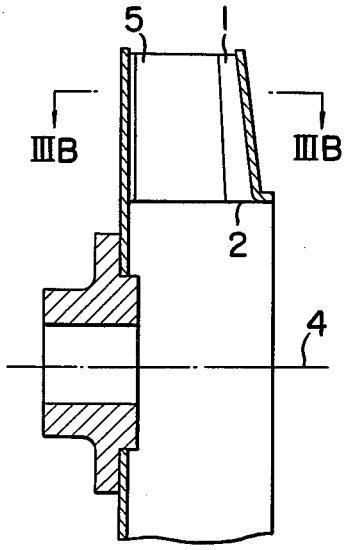
FIG. 3A PRIOR ART
FIG. 3A is a fragmentary axial section similar to FIG. 1 but showing a wear-resistant plate secured to a blade.
Figure 3B:
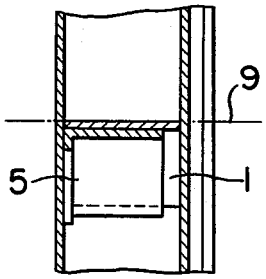
FIG. 3B PRIOR ART
FIG. 3B is a section taken along the line IIIB—IIIB in FIG. 3A.

A blade 1 of this type, however, is disadvantageous from the viewpoint of fluid dynamics because of its straight-line shape, and a fan provided with blades of this type has a much lower efficiency than a fan of the so-called turbo type in which each blade is curved rearwardly, and its radius of curvature varies progressively along its chord length C. Yet, in spite of this disadvantage, straight-line, rearwardly inclined type centrifugal fans are being used since their straight-line shape facilitates the fabrication of their blades. Another reason for their continued use is that, in the case where the fan is required to propel a dust containing gas, for example, a wear-resistant plate 5 can be readily secured to each blade 1 as shown in FIGS. 3A and 3B.

Figure 4:
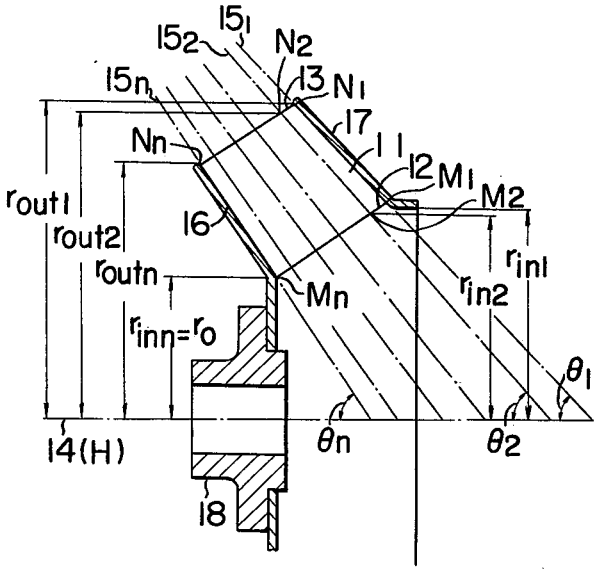
FIG. 4 is a side view similar to FIG. 1 but showing an example of a fan wheel of an ideal diagonal-flow fan.
Figure 5:
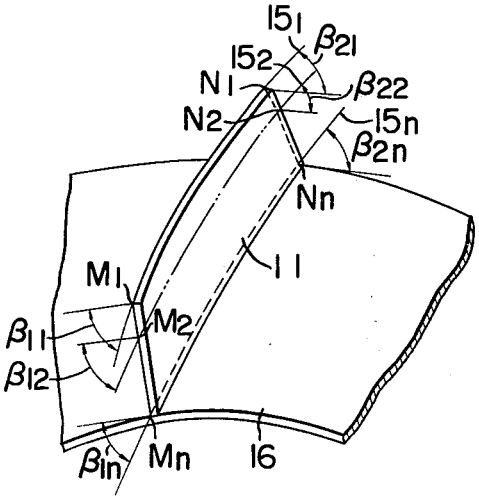
FIG. 5 is a fragmentary perspective view showing an essential part of the ideal fan wheel illustrated in FIG. 4.

Differing from the centrifugal fan, a diagonal-flow fan has a fan wheel, as shown in FIG. 4, with blades 11, whose entrance edges 12 and exit edges 13 are not parallel to the rotational shaft axis 14, and the radial distance to the rotational shaft axis 14, and the radial distance from the shaft axis 14 to the entrance edge 12 of each blade progressively varies as $r_{in1}$, $r_{in2}$, . . . $r_{inn}$ respectively at positions corresponding to representative streamlines $\mathbf{15}_1$, $\mathbf{15}_2$, . . . $\mathbf{15}_n$ in the gas flow path within the fan wheel. Furthermore, the radial distance from the shaft axis 14 to the exit edge 13 of each blade progressively varies as $r_{out1}$, $r_{out2}$, . . . $r_{outn}$. If these radii vary in this manner, the inflow angles at the entrance edge 12 for minimizing the collision loss for respective streamlines $\mathbf{15}_1$, $\mathbf{15}_2$, . . . $\mathbf{15}_n$ and the corresponding outflow angles for evening out the pressure head must be progressively varied as $\beta_{11}$, $\beta_{12}$, . . . $\beta_{1n}$ and $\beta_{21}$, $\beta_{22}$, . . . $\beta_{2n}$, respectively, as indicated in FIG. 5. It will therefore be understood that in order to obtain an ideal fan performance, the shape of each blade must be made to assume a complicated twisted double-curvature surface as viewed in the direction of the axis 14.

That is, if each planar blade 11 identical to the blade 1 in the centrifugal fan shown in FIG. 1 were to be mounted in the fan wheel of the diagonal-flow fan illustrated in FIG. 4 merely with an inclination matching the inclinations of the representative streamlines $\mathbf{15}_1$, $\mathbf{15}_2$, . . . $\mathbf{15}_n$, the fan performance would drop greatly except in the case of extremely small fans. If, in order to improve the performance, an attempt were to be made to fabricate blades 11 of the shape of a twisted, double-curvature surface, the fabrication would be very difficult. Furthermore, even if it were possible to fabricate such blades, they would not be able to compete, because of their high cost, with blades of centrifugal fans of the straight-line, rearwardly inclined type, which blades are easy to fabricate from the beginning and therefore are characterized by the advantage of low cost. Another disadvantage of such blades with double-curvature surfaces, in the case where dust-bearing gases are to handled, is that it is difficult to secure wear-resistant plates to these blade.

Basically considered, the fan wheels of fans of this character are fabricated, not by casting, but by assembling parts principally of rolled steel plates. Moreover, fans of a wide variety of dimensions, even up to large impellers of diameters of 3 to 4 meters, are produced in a great variety of kinds, each in small quantities. For this reason, it is very difficult to fabricate fan wheels of blades of the shape of a double-curvature surface at a cost which is not prohibitive.

Because of the foregoing reasons, centrifugal fans as described have been and are being widely produced, whereas diagonal-flow fans requiring double-curvature blades 11 have not been reduced to practice in spite of the great expections for their high performance.

Before describing the invention, a geometrical analysis of the theoretical shape of the blades of diagonal-flow fans will be made.

As partly described hereinbefore in conjunction with FIG. 4, a plurality of blades 11 are fixed by welding between shroud-like main and side plates 16 and 17, and the main plate 16 at its radially inner part is secured to a hub 18. The representative streamlines $\mathbf{15}_1$, $\mathbf{15}_2$, . . . $\mathbf{15}_n$ (which are actually "streamsurfaces" but will be herein referred to as "streamlines") respectively are in the shapes of conical surfaces of half vertex angles $\theta_1$, $\theta_2$, . . . $\theta_n$. Each blade 11 begins from entrance points (inlets) $M_1$, $M_2$, . . . $M_n$ on these conical surfaces and ends at exit points (outlets) $N_1$, $N_2$, . . . $N_n$. When the conical surface constituted by one ($\mathbf{15}_1$) of the representative streamlines is developed in a planar surface, it appears as in FIG. 6, in which a section of only one blade 11 is shown.

Figure 6:
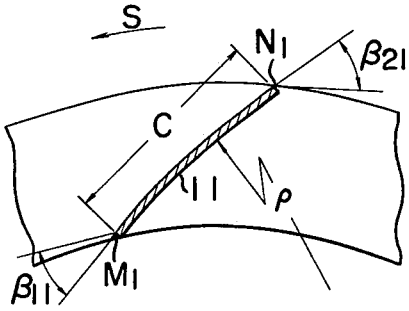
FIG. 6 is a flat planar development of a conical surface formed by a representative streamline shown in FIG. 4.

This section of the blade 11 in FIG. 6 has a specific inflow angle $\beta_{11}$ at the entrance point $M_1$ and a specific outlfow angle $\beta_{21}$ at the exit point $N_1$ and, in between, has a shape closely resembling a part of an ellipse and being of gradually varying radius $\rho$ of curvature. The inflow angles and outflow angles of this blade 11 vary as $\beta_{12}$, $\beta_{13}$, . . . $\beta_{1n}$ and $\beta_{22}$, $\beta_{23}$, . . . $\beta_{2n}$, respectively, from their values $\beta_{11}$ and $\beta_{21}$ as indicated in FIG. 5 in correspondence with the representative streamlines $\mathbf{15}_1$, $\mathbf{15}_2$, . . . $\mathbf{15}_n$ shown in FIG. 4. Accordingly, a complicated double-curvature surface is required for each blade 11, as was pointed out hereinbefore.

Figure 2:
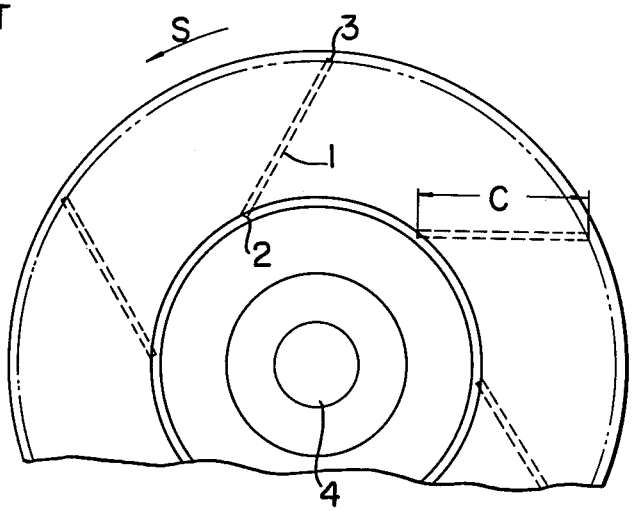
FIG. 2 PRIOR ART
FIG. 2 is a partial axial view of the same centrifugal fan.

A blade of a section corresponding to each representative streamline, which blade is inclined in a straight-line in the direction opposite to that of the rotational direction S as in the case of a fan wheel of a straight-line, rearwardly inclined type, centrifugal fan as illustrated in FIG. 2, appears to be simpler to fabricate than a blade of a varying radius of curvature. However, the conical surfaces constituted by the representative streamlines within the fan wheel respectively have different half vertex angles as mentioned hereinbefore. In addition, the inflow and outflow angles at the entrance and exit points corresponding to the representative streamlines respectively require progressively varying values. Therefore, it will be apparent that, on the contrary, a complicated double-curvature surface is required.

Figure 7:
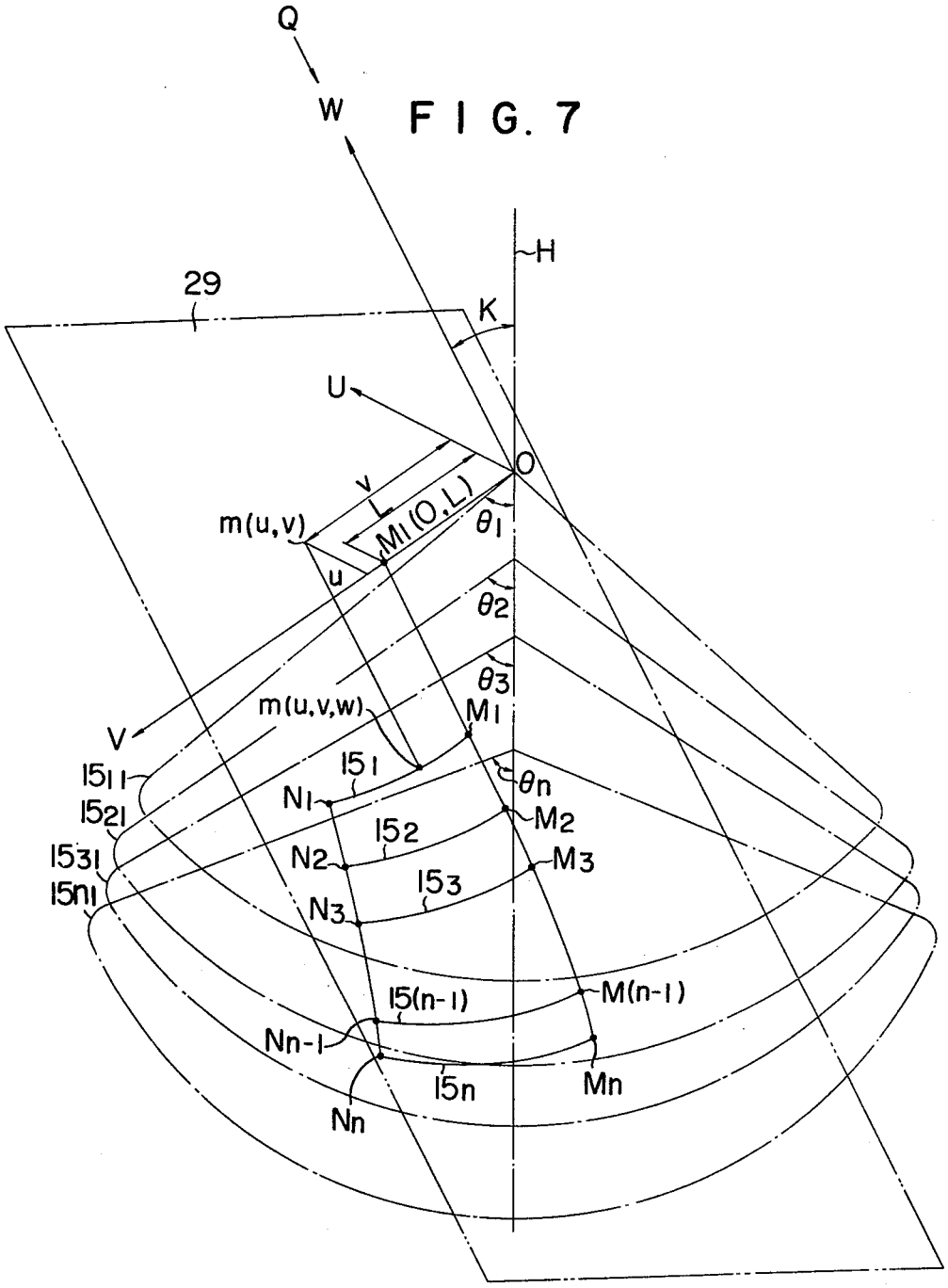
FIG. 7 is a graphical perspective view for a description of the fabrication of the shape for the flat blade of the fan wheel according to this invention.

FIG. 7 is a perspective view illustrating the principal of the invention and showing intersections between the conical surfaces constituted by the representative streamlines and an imaginary planar surface 29.

Figure 8A:
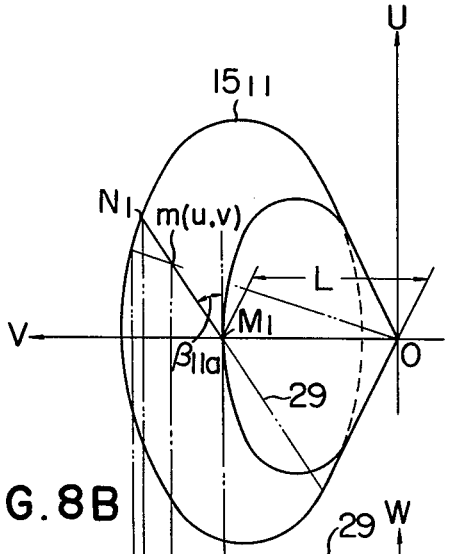
FIGS. 8A, 8B and 8C are respectively views explanatory of the basic principle of this invention.
Figure 8B:
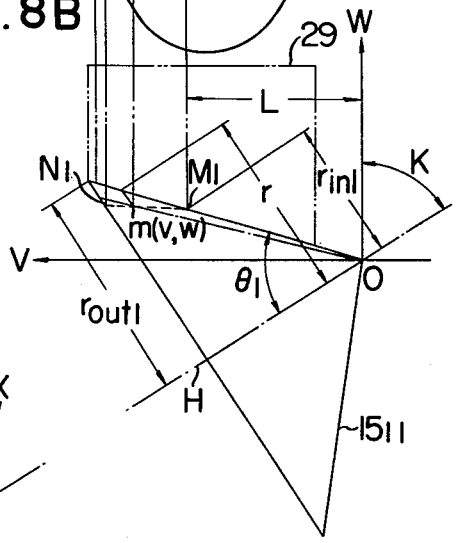
Figure 8C:
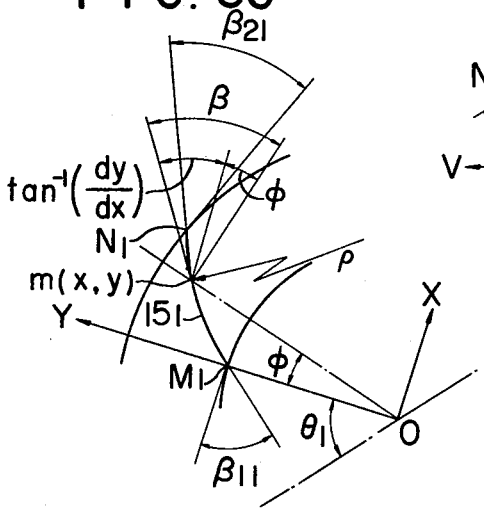

FIGS. 8A, 8B, and 8C show projectionally the intersection between the conical surface $\mathbf{15}_{11}$ constituted by the representative streamline $\mathbf{15}_1$ and the planar surface 29. The planar surface 29 contains an entrance point $M_1$ on the conical surface $\mathbf{15}_{11}$ and has an axis intersecting the conical surface $\mathbf{15}_{11}$ with an inclination angle of K relative to the central axis H of the conical surface $\mathbf{15}_{11}$.

In the figures, U, V, and W are orthogonal coordinate axes with their origin at the vertex O of the conical surface $\mathbf{15}_{11}$, axis W being parallel to the planar surface 29 containing the entrance point $M_1$ and, moreover, being inclines by the angle K relative to the central axis H of the conical surface $\mathbf{15}_{11}$, axis V being superimposed on the point $M_1$ when viewed in the direction of axis W as in FIG. 8A. From the manner in which the axis W is taken, the angle K is expressed as the angle between the axis W and the axis H. Furthermore, the V coordinate of the point $M_1$ is L. $\beta_{11a}$ is the angle between the plane 29 and the U axis.

The conical surface $\mathbf{15}_{11}$ is the same as the conical surface constituted by the representative streamline $\mathbf{15}_1$. Note that the vertex O of FIG. 7 corresponds to the intersection of streamline $\mathbf{15}_1$ and axis 14 of FIG. 4. The intersection line between this conical surface $\mathbf{15}_{11}$ and the planar surface 29, that is, that part from the point $M_1$ to the point $N_1$, is shown by thick line in the development of the conical surface $\mathbf{15}_{11}$ in FIG. 8C and is equivalent to that shown in FIG. 6. That is, the sectional profile of the blade 11 in the form of a smooth curve having specific inflow and outflow angles $\beta_{11}$ and $\beta_{21}$ on the conical surface of one representative streamline as shown in FIG. 6 and having a progressively varying radius of curvature $\rho$ between its entrance and exit points can be obtained geometrically by determining the distance L and the angle K shown in FIGS. 8A and 8B by a method described hereinafter.

That the sectional profile of the blade 11 becomes a smooth curve having a progressively varying radius of curvature $\rho$, in spite of the use of one portion of a planar surface, can be understood from the fact that the conical section produced by diagonally cutting a cone in an ellipse.

These relationships will now be geometrically studied. An arbitrary point m on the curve $M_1N_1$ constituting one part of the intersection between the conical surface $\mathbf{15}_{11}$ of the representative streamline $\mathbf{15}_1$ and the planar surface 29 in FIG. 8 will be considered. This point m has coordinates (u,v) in FIG. 8A, coordinates (v,w) in FIG. 18B, and coordinates (x,y) in FIG. 8C showing the development of the conical surface $\mathbf{15}_{11}$, the coordinates being based on the orthogonal coordinate axes X and Y as described hereinbefore.

In this case, the following relationships exist.

$$x=f(\theta_1, u, r) \ldots \quad (1)$$

$$y=f(\theta_1, u, r) \ldots \quad (2)$$

$$u=f(\theta_1, L, K, r) \ldots \quad (3)$$

$$\phi=f(\theta_1, u, r) \ldots \quad (4)$$

Where r is the distance of the point m from the centerline axis H as shown in FIG. 8B and $\phi$ is the angle between the axis Y and a straight line passing through the point m(x,y) and the origin of the axis Y. Therefore, by substituting the equations (1) through (4) respectively into the relationships $$\rho = \left[1 + \left(\frac{dy}{dx}\right)^2\right]^{3/2} / \frac{d^2y}{dx^2} \quad (5)$$

$$\beta = \tan^{-1}\left(\frac{dy}{dx}\right) + \phi \quad (6)$$

which are derived through differential analysis known in the art, the radius of curvature $\rho$ and the angle $\beta$ at the point m in FIG. 8C are obtained.

When the point m is at the entrance point $M_1$, the corresponding angle $\beta$ coincides with the inflow angle $\beta_{11}$. Similarly, when the point m is at the exit point $N_1$, the corresponding angle $\beta$ coincides with the outflow angle $\beta_{21}$. As the point m is moved from the point $M_1$ to the point $N_1$, the radius of curvature $\rho$ varies gradually. For this reason, the curve from the entrance point $M_1$ to the exit point $N_1$ is equivalent to that of a blade in a rearwardly curved type (so-called turbo type) fan wheel, which blade is considered to be ideal from the viewpoint of fluid dynamics. Thus, this blade differs considerably from that in the fan wheel of a conventional straight-line, rearwardly inclined type, centrifugal fan in which the streamline radius $\rho$ is infinity, that is, the blade is straight.

Thus, the representative streamline $\mathbf{15}_1$ is obtained as indicated in outline form in FIG. 7. In the same manner, the other representative streamlines $\mathbf{15}_2, \mathbf{15}_3, \ldots \mathbf{15}_n$ are obtained respectively from the intersections of the planar surface 29 and the conical surfaces $\mathbf{15}_{21}, \mathbf{15}_{31}, \ldots \mathbf{15}_{n1}$, to develope the shape of a flat blade.

Figure 9A:
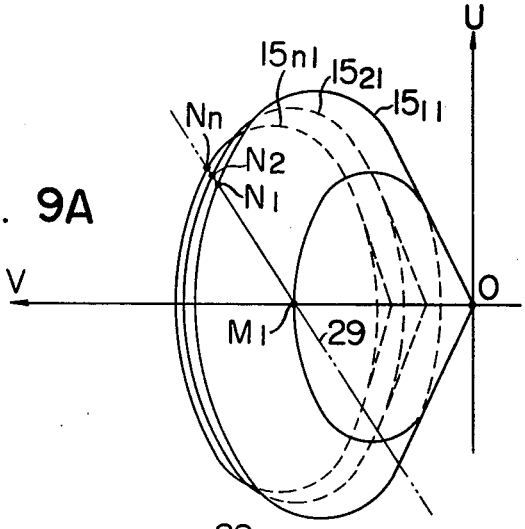
FIGS. 9A and 9B are respectively vertical and horizontal projections of FIG. 7.
Figure 9B:
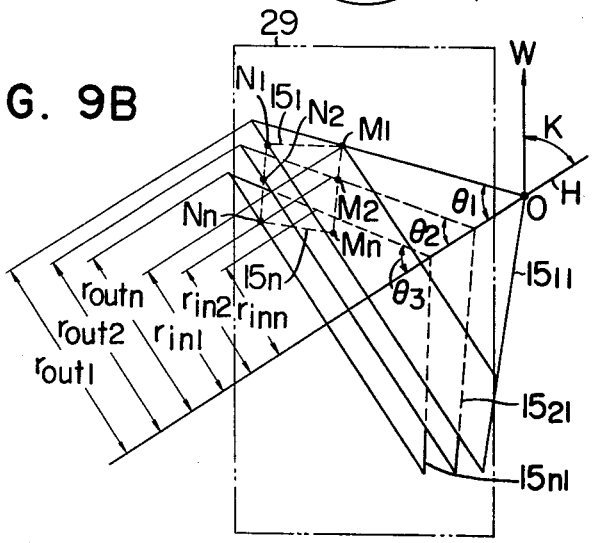

FIG. 9A shows a projection of this state as viewed in the arrow direction Q. This projection corresponds to FIG. 8A. Furthermore, FIG. 9B is a projection corresponding to FIG. 8B. These intersection lines can be readily computed by carrying out with respect to the conical surfaces $\mathbf{15}_{21}, \mathbf{15}_{31}, \ldots \mathbf{15}_{n1}$ operations similar to that with respect to the conical surface $\mathbf{15}_{11}$.

That is, FIGS. 9A and 9B are respectively FIGS. 8A and 8B with the further addition thereto of conical surfaces $\mathbf{15}_{21}, \mathbf{15}_{31}, \ldots \mathbf{15}_{n1}$ having a common centerline axis H with the conical surface $\mathbf{15}_{11}$ and respectively having half vertex angles $\theta_2, \theta_3, \ldots \theta_n$. These n conical surfaces $\mathbf{15}_{11}, \mathbf{15}_{21}, \ldots \mathbf{15}_n$ are arranged in the same manner as the n conical surfaces constituted by the representative streamlines $\mathbf{15}_1, \mathbf{15}_2, \ldots \mathbf{15}_n$, and, moreover, the blade 11 is substituted for one part of the planar surface 29 of FIG. 9.

As is apparent from FIGS. 7 and 9A, when the group of n conical surfaces inclined as shown therein is viewed in the direction of the axis W (arrow direction Q in FIG. 7), the blade 11, as one part of the plane of the planar surface 29, has no twist and appears as a superimposition with same sectional profile. When the conical surface $\mathbf{15}_{11}$ is developed into a planar surface, it becomes as shown in FIG. 8C as described before, and the other conical surfaces $\mathbf{15}_{21}, \mathbf{15}_{31}, \ldots \mathbf{15}_{n1}$ also can be similarly developed. The intersection lines due to these developments are not shown in FIG. 9, but, as indicated in outline form in FIG. 7, they respectively start at points $M_2, M_3, \ldots M_n$ and end at points $N_2, N_3, \ldots N_n$, having inflow angles $\beta_{12}, \beta_{13}, \ldots \beta_{1n}$ and outflow angles $\beta_{22}, \beta_{23}, \ldots \beta_{2n}$ respectively differing slightly from the inflow angle $\beta_{11}$ and the outflow angle $\beta_{21}$ at the streamline $\mathbf{15}_1$. Between the entrance and exit points, the intersection lines are in the form of smooth curves each having a gradually varying radius of curvature $\beta$.

That the inflow angles $\beta_{11}, \beta_{12}, \ldots \beta_{1n}$ and the outflow angles $\beta_{21}, \beta_{22}, \ldots \beta_{2n}$ respectively differ slightly from each other is a natural result of the variations of the radical distance $r_{in}$ at the entrance point and the radial distance $r_{out}$ at the exit point of each of the representative streamlines $\mathbf{15}_1, \mathbf{15}_2, \ldots \mathbf{15}_n$ as described hereinbefore with reference to FIG. 3.

When all intersection lines, that is, the representative streamlines $\mathbf{15}_1$ through $\mathbf{15}_n$ have been operationally determined, the part of the planar surface 29 enclosed by the curve $M_1$ to $N_1$ at the representative streamline $\mathbf{15}_1$, the curve $M_n$ to $N_n$ at the representative streamline $\mathbf{15}_n$, and the curves $M_2$ to $M_{(n-1)}$ and $N_2$ to $N_{(n-1)}$ of the remaining representative streamlines is cut out of the planar surface 29, which is actually a planar plate stock. The outline of this cut out figure can be readily determined from the coordinates of the point m, that is, m(u,v,w) in FIGS. 8A and 8B.

Figure 11:
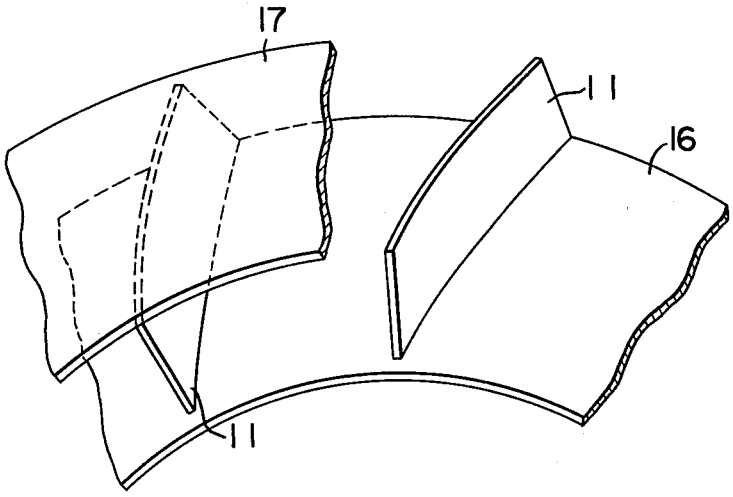
FIG. 11 is a fragmentary perspective view of one part of one example of the flat-bladed fan wheel of a diagonal-flow fan according to this invention.

Thus, by cutting out each blade 11 from a planar plate stock and securing it by a method such as welding or riveting to and between the main plate 16 and the side plate 17 as indicated in FIG. 11 thereby to assemble the fan wheel, a fan wheel of a performance equivalent to that of a fan wheel provided with blades of double-curvature surface, which were considered to be requisite for the fan wheel of a diagonal-flow fan, can be easily fabricated by the use of planar blades of simple fabrication, to which wear-resistant plates can be readily attached, without the use of such double-curvature blade.

Moreover, the blade 11 is equivalent to a rearwardly curved type (so-called turbo type) blade of progressively varying radius of curvature $\rho$, which is considered to be ideal from the viewpoint of fluid dynamics.

The above description in conjunction with FIGS. 8 and 9 relates to a blade of the so-called turbo type wherein the shape of the intersection lines, i.e., the blade 11, faces rearward and, moreover, is curved rearward, but, of course, this blade shape is not thus limited.

In the fan wheel of this invention, by progressively decreasing the angle K, because of the relationship of the half vertex angle $\Theta$, a so-called limit-load blade in which the shape of the blade 11 is rearwardly facing and, at the same time, varies from forward curvature to rearward curvature and, further, a so-called radial tip type blade in which the shape of the blade 11 is rearwardly facing and, at the same time, is forwardly curved can be obtained, although not shown in the drawings. In the blades, similarly as in the aforementioned turbo type, the inflow and outflow angles $\beta_{11}$ through $\beta_{1n}$ and $\beta_{21}$ through $\beta_{2n}$, which are necessary for a diagonal-flow fan wheel, are respectively caused to vary progressively, and the entrance and exit points can be joined by smooth curves having gradually varying radii of curvature $\rho$. In this case also, of course, the blade 11 is still one part of the planar surface 29 or planar plate stock.

In actually designing and producing a fan wheel according to this invention, the representative streamlines $\mathbf{15}_1$ through $\mathbf{15}_n$ to be realized are first determined. From these, the conical surface half vertex angles $\theta_1$ through $\theta_n$ are determined. Standard values of the ratio of the inner and outer diameters of each blade have been tentatively determined in accordance with the gas flow rate and delivery pressure. Therefore, from the rotational speed of the fan wheel, the inflow angles $\beta_{11}, \ldots \beta_{1n}$ at the blade entrance and the outflow angles $\beta_{21}, \ldots \beta_{2n}$ at the blade exit are determined. If an inner diameter $r_o$ of the fan wheel is taken as 1 (unity), the corresponding outer diameter of the fan wheel will be the ratio of the outer and inner diameters.

For the determination of the setting position of the planar surface 29, the distance L and the angle $\beta_{11a}$ shown in FIG. 8A are necessary. When the angle K has been determined, the distance L is determined from the radial distance $r_{in1}$ of the entrance point $M_1$ and the half vertex angle $\theta_1$ of the conical surface, and the angle $B_{11a}$ is determined from the half vertex angle $\Theta_1$ and the inflow angle $\beta_{11}$. Therefore, since the angle K is the only unknown variable, its value is so determined that the outflow angle $\beta_{21}$ at the exit point $N_1$ will become a specific value.

When the angle K has been determined in this manner, adjustments are made in the inner and outer diameters of the representative streamlines on the basis of these variables L, $\beta_{11a}$, and K so that, with respect to the conical surfaces constituted by these representative streamlines, the inflow and outflow angles will become specific respective values.

More specifically, after the angle K has been determined as above mentioned, it is now possible to plot the entrance and exit points $M_1$ and $N_1$ and to draw the curve $\mathbf{15}_1$ on a blank plate 29. This curve $\mathbf{15}_1$ can be readily determined from the coordinates of the point m, that is, m(u,v,w). The thus determined positions of the entrance and exit points $M_1$ and $N_1$ on the plate 29 become basic reference datum points from which the plotting of the other entrance and exit points $M_2, M_3, \ldots M_n$ and $N_2, N_3, \ldots N_n$ starts. The next procedure is to determine the positions of the adjoining entrance and exit points $M_2$ and $N_2$ on the line of intersection or curve $\mathbf{15}_2$. The determination of the positions of these points $M_2$ and $N_2$ is made by so adjusting the inner and outer radial distances thereof from the shaft axis with respect to the conical surface $\mathbf{15}_{21}$, in which the intersection line $\mathbf{15}_2$ lies, on the basis of the determined values of the variables K, L, and $\beta_{11a}$ as to obtain the predetermined inflow and outflow angles $\beta_{12}$ and $\beta_{22}$. If the thus determined positions of the points do not coincide substantially with expected positions, a different value of K is adopted and the same procedure as above stated is repeated. Thus, it becomes possible to plot the points $M_2$ and $N_2$ on the blank plate 29. The same procedure is repeated for the other conical streamline surfaces to determine the positions of the other points $M_3, M_4, \ldots M_n$ and $N_3, N_4, \ldots N_n$.

For convenience in design, data may be prepared in advance in the above described manner as design information, so that, when the inflow and outflow angles and the ratio of the outer and inner diameters of the fan wheel are given, the essential dimensions thereof can be immediately determined. For example, in the case of an inflow angle $\beta_1$, an outer-to-inner diameter ratio $\lambda$, and a conical vertex angle $\theta$, a graph with the vertex angle K as the abscissa and the outflow angle $\beta_2$ as the ordinate may be prepared beforehand.

Thus, the actual blade 11 is cut out from a blank plate. By inserting each blade 11 thus formed between the main plate 16 and the side plate 17 is indicated in FIG. 11 to assemble the fan wheel, a fan wheel of a performance equivalent to that of a fan wheel provided with blades of double-curvature surface, which were considered to be requisite for the fan wheel of a diagonal-flow fan, can be fabricated without the use of such double-curvature blades.

In the above description, the line of intersection $\mathbf{15}_1$ at one end was made a reference curve for a purpose of simplicity. However, in practical design, the reference curve is selected not from the line of intersection at one end but from the line in the middle of the blade. The use of such middle line as a reference curve is advantageous because it represents a mean streamline.

In practice, the plotting of the entrance and exits points as well as the drawing of the contour line of the blade on a blank plate can be made manually, but this procedure is most advantageously carried out by a computerized apparatus.

Figure 12:
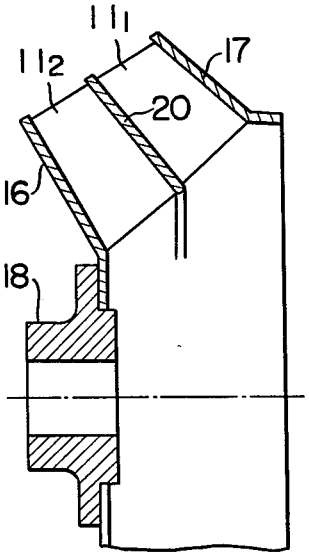
FIG. 12 is a partial side view similar to FIG. 4 but showing another example of a flat-bladed fan wheel according to the invention.

FIG. 12 illustrates one example of construction of a fan wheel wherein an intermediate plate 20 of conical shape is further installed between the main plate 16 and the side plate 17 in the fan wheel shown in FIG. 4, and all blades 11 are divided by this intermediate plate 20 into sections $\mathbf{11}_1$ and $\mathbf{11}_2$. Depending on the circumstances, a plurality of intermediate plates can be similarly installed thereby to divide the blades 11 into a greater number of sections.

The reason for such a measure is that, in the case where the requirements for variations of the inflow angles $\beta_{11}$ through $\beta_{1n}$ and the outflow angles $\beta_{21}$ through $\beta_{2n}$ cannot be satisfied for all of the representative streamlines $\mathbf{15}_1$ through $\mathbf{15}_n$ related to each blade 11 with only a single planar plane 29, blades produced by intersections with mutually different planes are afforded by this measure. Another reason is that, by this construction, the strength of the fan wheel itself is increased by the insertion of the intermediate plate 20. In the case where there is no such requirement, the intermediate plate 20 may be omitted, and, moreover, the plurality of blade sections $\mathbf{11}_1$ and $\mathbf{11}_2$ may be fabricated unitarily.

In accordance with the instant embodiment of this invention as described above, blades each consituting one part of a planar surface, which can be easily fabricated and to which wear-resistant materials can be readily affixed, are used instead of blades of double-curvature surfaces, which were heretofore considered to be necessary in the fan wheel of a straight-line, rearwardly inclined type, diagonal-flow fans, to produce a performance equivalent to that of fan wheels with double-curvature blades. Furthermore, in spite of the use of planar blades, the fan wheel of the instant embodiment of this invention exhibits a performance equivalent to that of the so-called turbo type fan wheel of rearwardly curved blade type having double-curvature blades, which are considered to be fluid dynamically ideal but impossible to realize in the fan wheel of a straight-line, rearwardly inclined type centrifugal fan.

That is, the inflow angles and outflow angles of each blade vary progressively in accordance with the positions taken in the gas flow path by the representative streamlines within the fan wheel. In addition, each curve extending from the corresponding entrance point to the exit point also has a shape which is not a straight line as seen in a straight-line, rearwardly-inclined centrifugal fan but is a curve which is close to the ideal according to fluid dynamics and has an arcuate radius varying progressively over the entire chord length. Furthermore, the blade shape according to this invention is applicable to not only a blade of the so-called rearwardly curved turbo type, but also to blades of fan wheels of the limit load type and of the radial tip type.

Figure 10:
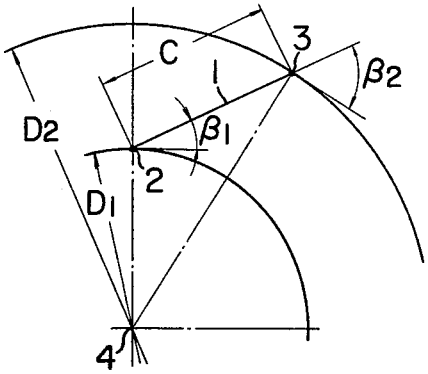
FIG. 10 is diagram indicating geometrical relationships relating to a blade.

In addition, in accordance with the instant embodiment of this invention, the following advantage is afforded. In the fan wheel of a straight-line, rearwardly inclined type, centrifugal fan, when the outer-to-inner diameter ratio $\lambda$ and the inflow angle $\beta_1$ at the entrance point have been determined, the outflow angle $\beta_2$ at the exit point is automatically determined from the geometrical relationships indicated in FIG. 10. That is, the following relationship is valid.

$$\beta_2 = 90° - \cos^{-1}[(C^2+\lambda^2-1)/2Cr\lambda] \ldots \quad (7)$$

where Cr is the ratio of the chord length C to the inner diameter $D_1$ of the blade, or ($Cr = C/D_1$).

$$CR = \sqrt{\sin^2\beta_1 + \lambda^{2-1}} - \sin\beta_1 \ldots \quad (8)$$

$\lambda$ is the outer-to-inner diameter ratio.

$$\lambda = D_2/D_1 \ldots \quad (9)$$

Ordinarily, the inflow angle $\beta_1$ at the entrance point is selected from experience at a value of 30 to 40 degrees for maximum efficiency. Accordingly, the outflow angle $\beta_2$ at the exit point of the blade of a straight-line, rearwardly inclined type, centrifugal fan wheel is determined by only the outer-to-inner diameter ratio $\lambda$.

Furthermore, the delivery head $H_{ad}$ is a function of the outflow angle $\beta_2$, the outer-to-inner diameter ratio $\lambda$, and the circumferential velocity $U_2$ of the blade exit as indicated by the following equation.

$$H_{ad} = f(\beta_2, \lambda, U_2) \ldots \quad (10)$$

This means that, if the outer-to-inner diameter ratio $\lambda$ and the inflow angle $\beta_1$ are given, the determining parameter for satisfying the required delivery head will be only the circumferential velocity $U_2$ at the blade exit, and a design matching the given specifications becomes disadvantageously difficult, differing from that of a rearwardly curved type blade of the same centrifugal type.

In contrast, in the case of the fan wheel of this invention of the straight-line, rearwardly inclined type, diagonal-flow fan, as described hereinabove, the outflow angle $\beta_2$ can be changed by changing the setting angle of the intersecting planar surface even when, for example, the inflow angle $\beta_1$ and the outer-to-inner diameter ratio have been determined. This means that the angle K can be used in addition to the circumferential velocity $U_2$ of the blade exit as a parameter for satisfying the required delivery head $H_{ad}$, and, by combining these parameters, a design matching the given specifications can be carried out without difficulty.

Thus, this invention provides a fan wheel of a straight-line, rearwardly inclined type, diagonal-flow fan which fan wheel can be easily fabricated at low cost and, moreover, can be readily provided with wear-resistant plates since planar blades are used. As mentioned hereinbefore, a fan of this character has not heretofore been successfully reduced to a practical product in spite of the great expectations for its high performance intermediate between those of centrifugal fans and axial-flow fans because it was thought to require complicated double-curvature blades, which are difficult to fabricate.

What we claim is:

1. A fan wheel of a diagonal-flow fan for propelling a flow of a gas, said fan wheel comprising: a rotational shaft, a frustoconical main plate coaxially fixed to the shaft, a frustoconical side plate spaced apart from the main plate and forming therebetween a diagonal flow path for the gas, a plurality of fan blades disposed circumferentially of the diagonal flow path, each fixed at opposite side edges respectively to the inner surfaces of the main and side plates, said blades having an inner entrance part and an outer exit part, said entrance and exit part respectively, extending transverse to said diagonal flow path, each of said fan blades being defined by a plate having a surface shape conforming to a portion of a planar surface, said portion being formed of successive mutual intersection lines ($\mathbf{15}_1$, $\mathbf{15}_2$, $\mathbf{15}_3$, . . . $\mathbf{15}_{n-1}$ and $\mathbf{15}_n$) between said planar surface and successive coaxial conical surfaces ($\mathbf{15}_{11}$, $\mathbf{15}_{21}$, $\mathbf{15}_{31}$, . . . and $\mathbf{15}_{n1}$), corresponding to ideal stream surfaces, having a common centerline axis (H) and coinciding with the axis (14) of said rotational shaft, said planar surface being in parallel relation to a line (W) which crosses said axis (14) of the rotational shaft at an angle (K) therewith, said planar surface being at an angle ($\beta_{11a}$) with a plane passing through both said line (W) and said axis (14) of the rotational shaft.

2. A fan wheel as set forth in claim 1 wherein each of said blades is divided axially into two blade sections, which have different surface shapes having the same nature as said surface shape and conforming to portions of different imaginary planar surfaces, respectively.

* * * * *